US005622562A

United States Patent [19]

Innes et al.

[11] Patent Number: 5,622,562

[45] Date of Patent: Apr. 22, 1997

[54] COATING STRIP MATERIAL WITH PROTECTIVE DECORATIVE LAYERS WHILE AVOIDING USE OF SOLVENTS

[75] Inventors: Robert A. Innes, Kingston; Neil L. Brockman, Lansdowne, both of Canada

[73] Assignee: Alcan International Limited, Montreal, Canada

[21] Appl. No.: 449,418

[22] Filed: May 24, 1995

Related U.S. Application Data

[60] Division of Ser. No. 344,562, Nov. 23, 1994, abandoned, which is a continuation-in-part of Ser. No. 68,990, May 27, 1993.

[51] Int. Cl.[6] ..... B05C 5/00

[52] U.S. Cl. ..... 118/410; 118/413; 118/416; 118/420

[58] Field of Search ..... 118/410, 413, 118/416, 420

[56] References Cited

U.S. PATENT DOCUMENTS

| | | | |
|---|---|---|---|
| 3,690,297 | 9/1972 | Dentch et al. . | |
| 3,930,464 | 1/1976 | Wallstén . | |
| 4,102,300 | 7/1978 | Robert et al. | 118/420 |
| 4,299,186 | 11/1981 | Pipkin et al. . | |
| 4,388,349 | 6/1983 | Korpman et al. . | |
| 4,450,226 | 5/1984 | Bloothoofd . | |
| 4,675,230 | 6/1987 | Innes . | |
| 5,294,258 | 3/1994 | Jarrell et al. | 118/410 |

FOREIGN PATENT DOCUMENTS

| | | |
|---|---|---|
| 0135922 | 4/1985 | European Pat. Off. . |
| 0298598 | 11/1988 | European Pat. Off. . |
| 2260395 | 9/1975 | France . |
| 2473361 | 7/1981 | France . |
| WO9401224 | 1/1994 | WIPO . |

*Primary Examiner*—Laura Edwards
*Attorney, Agent, or Firm*—Cooper & Dunham LLP

[57] ABSTRACT

A process and apparatus for coating a surface of an elongated strip article, e.g. aluminum sheet, with a layer of solid polymer material. The process involves heating the polymer to produce a melt having a viscosity of at least 1000 centipoise when measured according to ASTM D4449 at 1 radian per second, extruding the melt onto a moving surface of the strip article through an elongated slot in a coating head having an extended surface adjacent to the slot arranged at an angle to the moving surface to form a coating gap converging in the direction of movement, thereby forming a coating on the strip article, and pushing the coating head towards the surface of the strip article as the melt is extruded as the coating onto the surface from the slot to reduce the coating thickness to a desired range by pressing the extended surface of the coating head onto the coating as the coating is formed. The apparatus includes coating heat, provided with a heater to maintain the viscosity of the melt, and load application device for the coating head, as well as equipment for melting the polymer and supplying the melt under pressure and at the desired temperature to the coating head. The process and apparatus allows strip articles to be coated with thin (1–100 microns) coatings of polymer materials without employing liquids as solvents or the like that cause atmospheric pollution problems.

6 Claims, 2 Drawing Sheets

COATING STRIP MATERIAL WITH PROTECTIVE DECORATIVE LAYERS WHILE AVOIDING USE OF SOLVENTS

CROSS-REFERENCE TO RELATED APPLICATION

This is a division of application Ser. No. 344,562, filed Nov. 23, 1994, now abandoned which is a continuation-in-part of application Ser. No. 068,990, filed May 27, 1993.

BACKGROUND OF THE INVENTION

I. Field of the Invention

This invention relates to the coating of strip material, particularly metal sheet, with protective and/or decorative layers of solids while avoiding the addition of liquids such as solvents, softeners, suspension media, or the like.

II. Description of the Prior Art

Metal sheet material, for example thin aluminum strip used for beverage cans and other purposes, is frequently coated with organic films to provide surface protection and/or decorative finishes. The coatings are typically applied by dissolving or suspending polymers and other components in organic solvents, applying the resulting mixtures by roller coater or doctor blade to the strip, and baking the resulting product to remove the solvents and to cross-link the polymer.

Unfortunately, the solvents emitted during this conventional procedure cause environmental problems, thus necessitating the use of expensive pollution control systems and complex ovens to avoid the build-up of flammable vapors to explosive concentrations. Also, in order to ensure that the coating polymers will properly dissolve, it is often necessary to use lower molecular weight polymers than would be desirable for providing ideal coating properties.

As an alternative to roller coating, so-called "falling film" extrusion coating of aluminum foil and paper with molten polymer coating materials is well known. The thickness of the coating is normally controlled by extruding the molten polymer from a slot in an extrusion head positioned several centimeters above a moving strip in the form of a film having a grater thickness than that finally required and then thinning the film by stretching it as a free (unsupported) film under the combined effect of gravity and tension before applying it to the surface of the strip. This demands special rheological characteristics of the coatings material so that it can stretch without breaking. It is also very difficult to achieve thicknesses as low as 2 to 7 microns that are typical for aluminum packaging applications, such as aluminum beverage can ends.

An alternate means of controlling coating thickness during extrusion coating is to employ an extrusion die movably connected to a supporting structure, having an extrusion opening and die lips of a suitable shape positioned around the extrusion opening. The die lips are moved close to the strip an the clearance between grip and die lips is precisely controlled by adjusting the position of the extrusion head relative to the supporting structure. In such an arrangement, the thickness uniformity of the coating depends on the precision used in the manufacture and control of the die and the precision of the support roll normally used to support the sheet material during coating, as well as the uniformity of the metal gauge along the strip, and it proves very difficult in practice to produce uniform coatings of the desired thickness in an acceptable manner. For example, if a mechanical spacer, such as a roller, is used to maintain a uniform clearance between the die lips and the strip, unsightly marks may be made on the surface of the strip by the spacer and the marks may not be completely hidden by the applied coating.

An apparatus and method suitable for single-sided coating of a sheet material without reliance on mechanical spacers that contact the strip is disclosed in U.S. Pat. No. 4,675,230 of Jun. 23, 1987, assigned to the same assignee as the present application (the disclosure of which patent is incorporated herein by reference). Moreover, a related apparatus and method of two-sided coating of sheet material is disclosed in pending U.S. Pat. application Ser. No. 08/068,990, filed May 27, 1993 and assigned to the same assignee as the present application (the disclosure of which application is also incorporated herein by reference). The types of apparatus disclosed in this patent and patent application relay on the hydrodynamics of the coating material as it is applied to the strip for control of the film thickness and can readily compensate for variations in the gauge of the strip and any eccentricity of the support roll. This is achieved by using a coating head having a slot and an extended surface on the downstream side of the slot forming an angle with the moving strip converging in the direction of the strip travel. The extended surface directly contacts the coating material as it is applied to the strip, thereby generating hydrodynamic forces that cause the head to "float" on the layer of coating as it is being applied. Direct contact between the strip and the coating head is thus avoided, and this in turn avoids damage to or defacement of the metal or pre-coated metal surface to which the coating is applied.

The problem with devices of this particular kind is that, while they can generally handle coating materials having viscosities that are greater than the viscosities of coating materials applied by other coating techniques, for example conventional roller coaters, they still require the coating material to be of fairly low viscosity, so it has been necessary to dissolve or suspend the polymeric coating material in a suitable solvent, thereby creating the difficulties mentioned above.

There is therefore a need for a method and apparatus capable of coating a strip material with a polymeric coating layer in an efficient and convenient way without resort to the use of polymer solutions or dispersions.

SUMMARY OF THE INVENTION

An object of the present invention is to enable the coating of strip material to be carried out without resort to the use of solvents or similar liquids for dissolving, suspending or thinning the polymer coating material.

Another object of the invention is to make such strip coating possible using equipment that applies the coating material from an extrusion die without resort to stretching of the coating film before its application to the strip surface.

Yet another object of the invention is to make it possible to coat strip materials with polymeric coatings having thicknesses suitable for aluminum packaging applications without resort to the use of solvents or similar liquids during the coating process.

The present invention is based on the unexpected finding that modified versions of coating dies of the type disclosed in U.S. Pat. No. 4,675,230 and in pending U.S. Pat. No. application Ser. No. 08/068,990 can be used for the application of high viscosity molten polymers to surfaces of moving strips, if such polymers are maintained at a suitable viscosity, by being suitably heated, and if they are applied to the die under suitable pressures. The disadvantageous use of solvents or other liquids can thus be avoided and yet coatings of the desired thicknesses can be produced.

According to one aspect of the invention, there is provided a process of coating a surface of an elongated strip article with a layer of solid polymer material, comprising: heating the solid to produce a shear-thinning fluid melt having a viscosity as measured by the method of ASTM D4440 at one radian per second of at least 1000 CPS; extruding the melt onto a moving surface of the strip article through an elongated slot in a coating head having an extended surface adjacent to the slot, and forming an angle with the moving strip converging in the direction of the strip movement, to form a coating on the article; and pushing the coating head towards the surface of the strip article as said melt is extruded as a coating onto the surface from the slot to reduce a coating thickness coating by pressing said extended surface of the coating head onto said coating as the coating is formed.

According to another aspect of the invention, there is provided apparatus for coating a major surface of an elongated strip article with a solid coating layer, comprising: a heated coating head having an elongated open-sided slot and an extended surface immediately adjacent to the open side of the slot; melting apparatus for heating a solid material to form a melt and for delivering said melt under pressure to said coating head; a support for the coating had permitting translational movement of the head towards and away from said major surface of the strip article; and a load application device for pushing the coating had towards the major surface of the strip article as said melt is extruded as a coating onto the surface from the slot to reduce thickness of the coating by pressing said extended surface of the coating head onto said coating as the coating is formed.

The process and apparatus of the invention can surprisingly produce coatings as thin as 1–100 μm, and even 1–25 μm, without resorting to the use of liquids as solvents, diluents, etc. In particular, this means that coatings for aluminum strip in the desired range of 2–7 μm can be produced without the usual attendant disadvantages mentioned above. The use of a "floating" head makes it possible to coat relatively wide strip materials since the coating head can be pushed at various positions across the width of the strip by a suitable load application devices, thus forcing all parts of the coating head to follow both the transverse as well as the longitudinal contours of the strip.

The polymers employed in the present invention are those which produce shear-thinning fluid melts having viscosities of at least 1000 centipoise (CPS), more preferably at least 5000 CPS, and even more preferably at least 50,000 CPS, upon being heated above their melting temperature but below their decomposition temperatures. Shear-thinning fluids are those having viscosities that decrease as the shear rates, to which they are subjected, increase. In the present invention, as indicated above, the viscosities are measured by the procedure of standard test ASTM D4440 (approved on Nov. 30, 1984) of the American Society of Testing and Materials (the disclosure of which is incorporated herein by reference) at a shear rate of 1 radian per second.

Without wishing to be bound by any particular theory, it is speculated that the process and apparatus of the present invention are successful in producing thin coatings of polymer materials directly from polymer melts because the polymer melts are subjected to high shear conditions in the coating gap formed between the coating head and the surface of the strip article as the melts are being extruded. Accordingly, because of the shear-thinning nature of the polymer melt, the effective viscosity of the melt in the gap may be much lower than expected (i.e. much lower than the melt when static) and thus thinner coatings than theoretically expected may be metered out.

The shear rate to which the polymer melt is subjected during coating depends on the velocity (v) of the moving strip and the separation distance (x) between the part of the coating head surface that is closest to the moving strip and strip surface itself. The shear can be represented by the equation: SHEAR=v/x.

To reduce the viscosity of the melt as much as possible, it is normally desirable to maintain the melt at the highest possible temperature above the polymer melting point (which can be determined by standard differential scanning calorimetry) without causing degradation. This optimum temperature differs from polymer to polymer, but can be determined for any suitable polymer by simple trial and experimentation.

The pressure at which the fluid melt is applied to the coating head depends on the viscosity of the melt and on any viscosity drop that occurs in the coating gap. Again, suitable pressures can be determined by simple trial and experimentation and can be generated by any suitable means for pressurizing a high viscosity fluid, e.g. high pressure pumps, although it is preferred to use a heated screw type extruder to simultaneously mix, melt, pressurize and deliver the polymer to the coating head.

While the invention is primarily concerned with the coating of sheet articles made of metals, it should be kept in mind that it may also be used for coating other sheet articles, e.g. paper strip articles.

DETAILED DESCRIPTION OF THE PREFERRED EMBODIMENTS

Figure 1:
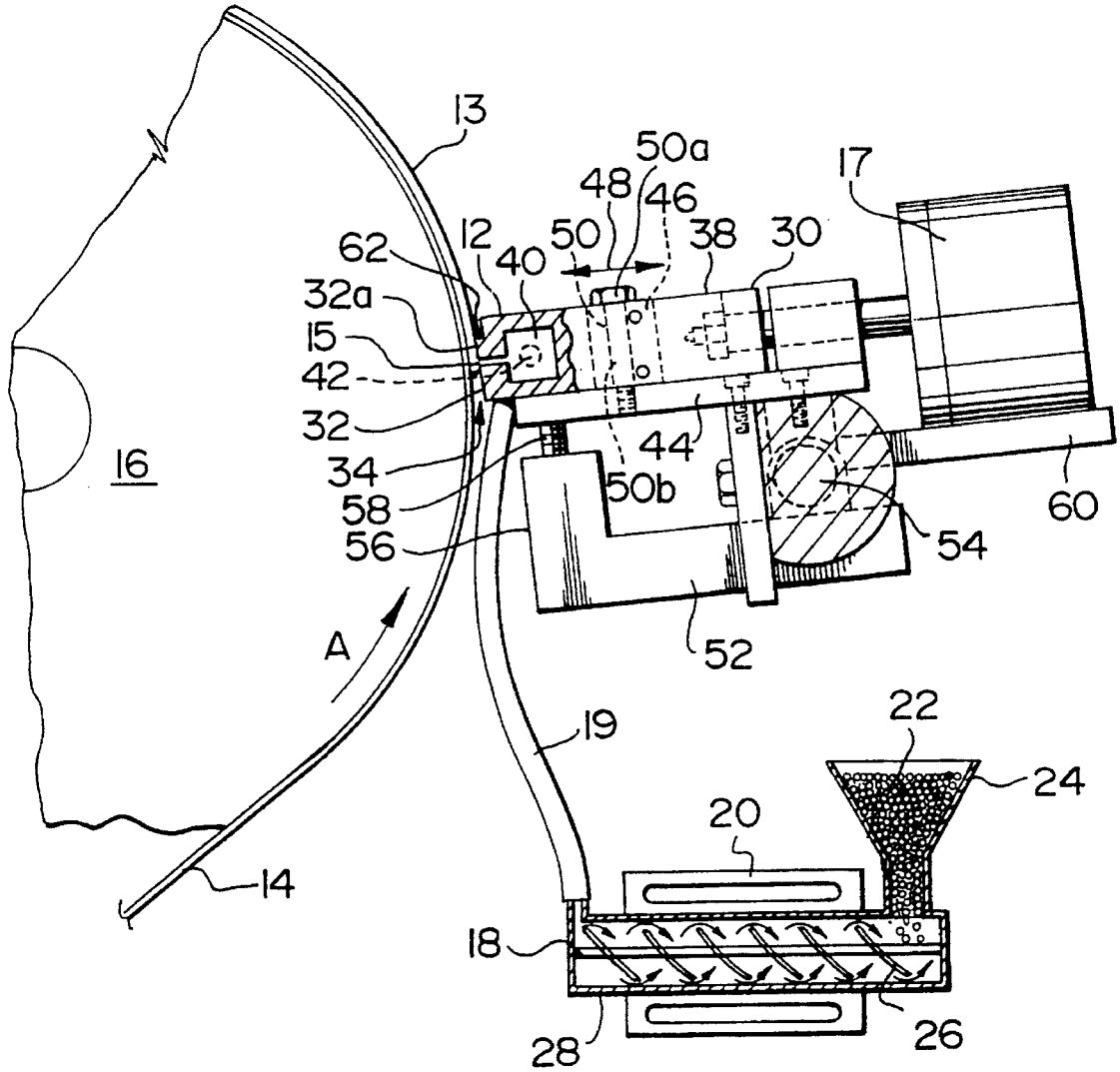
FIG. 1 is a side elevational view, partly in cross-section, of an apparatus for carrying out a preferred aspect of the present invention.

The apparatus shown in FIG. 1 is intended for coating metal strip articles and consists of a coating head 12 similar to the head described in application Ser. No. 08/068,990 mentioned above, except that the head is heated and the interior passages are modified for streamlined polymer flow to improve flow uniformity and to avoid "dead zones" that might cause degradation of the heated polymer.

The coating head 12 (shown partially in cross-section) applies a layer of polymer coating material 13 to an aluminum strip 14 passing around a heated backup drum 16 in the direction of the arrow A. The coating head 12 extends over the entire transverse width of the strip at a locality, in the path of the strip advance, at which the strip is held firmly against the surface of the backup drum 16. A system of spaced air cylinders 17 (only one of which is shown) urges the coating head 12 towards the strip 14 at a number of locations along the width of the strip to apply a suitable load to the coating material 13 as it is applied to the strip surface, causing the head to "float" on the layer of molten coating material 13 applied through elongated coating slot 15, while metering the thickness of the applied coating. As noted above, the head includes integral heaters (not shown) to ensure uniform temperature and viscosity of the extruded polymer.

The coating head 12 is fed with heated molten polymer coating material from a screw extruder 18 (shown in cross-section) via one or more heated high pressure hoses 19. The hose 19 may be a conventional flexible hose first wrapped with an electrical heating element (wire) and then wrapped with flexible insulation. The screw extruder 18, which, itself is heated by integral heaters 20, heats, mixes, compresses and pressurizes a pelletized plastic coating material 22 withdrawn from a hopper 24. The mixing action takes place as the pressure inside the extruder builds towards the front of the extruder and a backward counterflow of material takes place (as indicated by the small arrows) in the gap between the screw mechanism 26 and the extruder wall 28.

By heating each of the extruder 18, the high pressure hose 19, the coating head 12 and the backup drum 16, the polymer material 13 can be kept in molten condition within the viscosity range mentioned earlier until applied as a coating to the strip 14. It will be understood that the surface of the strip 14 may bear a previously applied undercoat or primer coat of paint, and the opposite surface of the strip may also be precoated.

Beyond the drum 16, the strip is allowed to cool sufficiently to solidify the polymer material 13 and can then be coiled in the conventional manner. If necessary, however, the strip may be subjected to a further heat treatment or baking step after being coated in the indicated manner in order to ensure proper curing or bonding of the coating to the strip article.

By using equipment of this kind, the polymer material can successfully be coated in thin layers onto the strip article 14 by a dynamic load control mechanism as opposed simply to a static adjustment of the gap between the coating head and the strip. This is surprising, because molten polymer has a high viscosity normally in the range of 1,000 to 2,000,000 CPS (often 10,000 to 1,000,000 CPS at 1 rad./sec according to the ASTM D4440 test mentioned above).

It will be seen from FIG. 1 that the coating head 12 forms part of a rigid metal block 30 having a flat or concavely curved coating surface 32 arranged at an angle (normally in the range of 0.1 to 5°, or more preferably 0.5 to 1°) to the surface of the moving strip 14 forming a gap 34 converging in the direction of the strip travel. The part of the coating surface downstream of the coating slot 15 forms an extended surface **32*a* that contacts the polymer melt as it is applied and receives the hydrodynamic force of the melt as it moves through the converging coating gap 34**.

The elongated extrusion slot 15, which opens outwardly through the surface 32 of the block 30, opens inwardly into a melt cavity 40 that is fully enclosed by the block 30 except for a polymer delivery apertures 42 communicating with pressure hose 19. The slot 15 is orientated with its long dimension transverse to the direction of advance of the strip 14; very preferably, the long dimension of the slot is perpendicular to the direction of strip advance and parallel to the axis of rotation of the drum 16.

In operation, heated molten polymer is continuously supplied under pressure by the screw extruder 18 to the internal melt cavity 40 and thence to the slot 15 at a rate sufficient to keep the cavity 40 entirely filled and to force the polymer from the slot 15 under pressure so that the slot, as well, is continuously entirely filled with polymer under pressure.

The apparatus includes a deck 44 having a flat upper surface on which the metal block 30 rests, the block being thus supported for sliding movement back and forth relative to the deck in a generally horizontal direction as shown by arrows 48. A series of vertically opening slots 46 (only one of which is shown), elongated horizontally in the direction of arrow 48, are formed in the body of the block 30 rearwardly of the cavity 40 at locations spaced along the length of the block. A series of bolts 50 (again only one of which is shown) respectively extend through these slots and are threaded into the deck at one end while having enlarged bolt heads **50*a* at the other end to retain the block 30 on the deck 44. Interference between the bolt shanks 50*b* and the side walls of the slots 46 prevents lateral movement of the block 30 relative to the deck, but the elongation of the slots permits the block 30 to move in the direction of arrow 48** through the full range of operative head positions.

The deck 44 is mounted on a feed frame 52 for pivotal movement about a horizontal axis 54, so as to enable the block 30, with the deck 44, to be swung upwardly (e.g. by suitable pneumatic means, not shown) from the position illustrated in FIG. 1 to a position removed from the path of strip advance. An arm 56, fixedly secured to the frame 52 and underlying the deck 44, carries a screw 58 that projects upwardly from the arm and bears against the lower surface of the deck 44, to enable adjustment of the angular orientation of the head 12 to its operative position.

The frame 52 is fixed in position relative to the axis of the drum 16, both the frame and the drum being mounted in a common support structure (not shown). Thus, the axis 54 is fixed in position relative to the axis of the drum 16 and when the deck 44 is in the operative position shown in FIG. 1, with the screw 58 set to provide a desired angular orientation, the drum 16 supports the advancing strip 14, opposite the slot 36, at a fixed distance from the deck 44.

The air cylinders 17 (which may be of generally conventional construction and which act as load application devices) are fixed securely to the deck 44 rearwardly of the block 30. As shown, the cylinders 17 are secured to the rearwardly projecting ledge portions 60 of the deck. Actuation of the cylinders causes the block 30 to be pushed towards the surface of the strip 14. As already noted, this load is opposed by the hydrodynamic fluid pressure of the molten polymer 13 created by the converging gap 34 between the strip surface 14 and the opposed extended surface **32*a* of the coating head 12 and the head 12 thus "floats" on the polymer layer 13. A metering orifice is thus defined between an upstream edge 62 of the surface 32*a* and the adjacent surface of the strip 14, the size of the metering orifice being determined (for a given polymer) by the magnitude of the load exerted by the cylinders. Hence, coatings of a desired thickness can be produced, even very thin coatings having thicknesses in the range of 1 to 25 microns, as mentioned previously, and more preferably 2 to 7 microns. No direct mechanical contact takes place between the coating head 12 and the strip 14**, so defacement of the surface of the strip is prevented.

Although the illustrated apparatus is designed for single-sided coating, the invention may also be utilized for two-sided coating using apparatus of the type disclosed in the co-pending application mentioned above, except modified to be fed with a molten polymer as in the apparatus described for single-sided coating.

Figure 2:
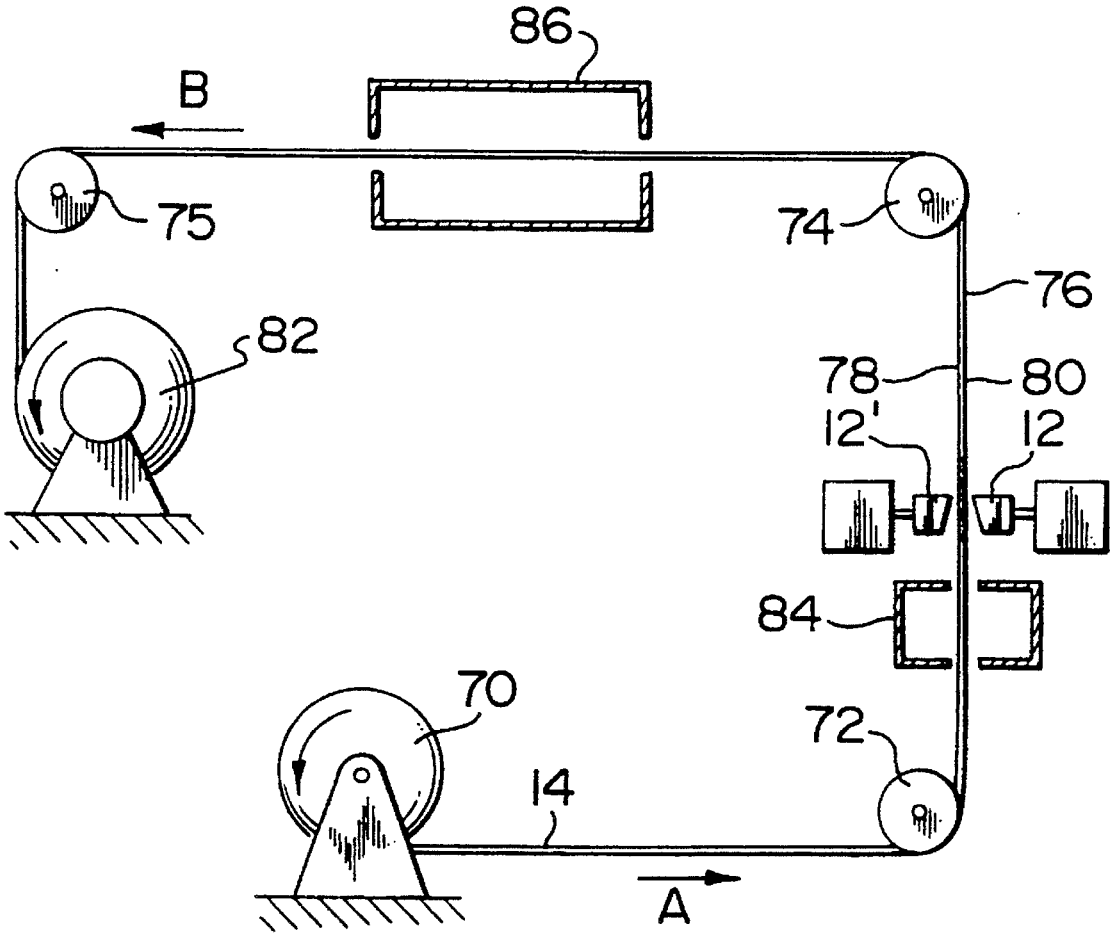
FIG. 2 is a simplified schematic representation of apparatus for carrying out another preferred aspect of the invention.

An example of an apparatus suitable for double-sided coating is shown schematically in FIG. 2. Metal strip 14 to be coated is continuously advanced, in a direction longitudinally parallel to its long dimension, from a coil 70 along a path represented by arrows A and B extending successively around spaced guide rollers 72, 74 and 75 rotatably supported (by structure not shown) in axially fixed positions. The rollers 72 and 74 cooperatively define a rectilinear portion 76 of the path, in which portion the major surfaces of the advancing strip are substantially planar. At a locality in this path portion 76, polymer is applied to both major surfaces 78, 80 of the strip from two coating devices 12, 12' (disposed in register with each other and respectively facing the two major surfaces of the strip article) to establish on each of the strip surfaces a continuous layer or coating of the polymer. The coating devices 12 and 12' may each be the same as the coating device 12 of the embodiment shown in FIG. 1 and may each be provided with heated polymer melt in the same fashion as previously described. As in the case of the previous embodiment, it will be understood that either or both of the trip major surfaces may bear a previously applied undercoat or primer coat of paint.

After passing roll 75, the coated strip is coiled again, e.g. on a driven rewind reel 82 which constitutes the means for advancing the strip through the coating line.

Since there is no heated support drum 16 in this embodiment, as there is in the embodiment of FIG. 1, the strip 14 may, if necessary, be advanced through a heating oven 84 immediately upstream of the positions of the coating heads 12, 12', to provide pre-heating of the strip prior to the application of the polymer coating in order to maintain suitable viscosity of the coating at the coating heads.

Furthermore, the strip may, if necessary, be advanced through a further heating oven 86 after being coated with the polymer coating material if post-coating heating is required to assure proper bonding of the polymer coating to the strip, which may be the case for some polymer coatings and strip surfaces.

Polymeric materials suitable for use in the apparatus of the invention (i.e. in the embodiments of both FIGS. 1 and 2) are those having viscosities in the ranges stated above at temperatures between their melting points and their decomposition temperatures, i.e. normally at temperatures in the range of 150° to 350° C. Examples of suitable polymers include polyethylene (e.g. EPOLENE® C-17 or C-13 polyethylene wax; effective temperature range 150°–260° C.), polyethylene terephthalate (e.g. VECODER® EPPN; effective temperature range 200°–340° C.) and mixtures of ethylene acrylic acid copolymer and polybutylene (e.g. PRIMACOR® 3400 - 75% PRIMACOR® and 25% SHELL® PB 0300; effective temperature range 160°–310° C.).

The invention is illustrated further by the following Examples, which are not intended to limit the scope of the invention.

EXAMPLE 1

A powerful and sophisticated extruder (model 1.75 18:1 having a ¾ inch screw with an 18 to 1 length to diameter ratio from Bramptom Engineering) was connected to a single-sided coater of the type disclosed in U.S. Pat. No. 4,675,230 and a gas heater was installed to preheat the backup drum. The coater head itself was a simple rigid coating head, originally designed for liquid coatings, approximately 125 mm wide with attached heaters.

This equipment was used to apply films of molten polymer as thin as 3 microns to aluminum can end stock and to foil lidstock for pet food cans. The equipment was operated as fast as 690 feet per minute.

Conditions for and results of various runs employing this equipment were as follows:

| | |
|---|---|
| | Run 1 |
| Polymer: | Eastman-Kodak EPOLENE ® C-13, a low molecular weight polyethylene modified for good adhesion. |
| Extruder temperature: | 200° C. |
| Hose temperature: | 200° C. |
| Head temperature: | 220° C. |
| Head angle: | 0.6 degrees |
| Air cylinder pressure: | 90 psi |
| Extruder drive frequency: | 6 Hz |
| Backup drum temperature: | 65° C. |
| Strip speed: | 100 feet per minute |
| Film thickness profile: (microns) | 14.1, 8.4, 5.0, 6.0, 12.5 |
| | Run 2 |
| Polymer: | EPOLENE ® C-17, a low molecular weight polyethylene modified for good adhesion |
| Extruder temperature: | 220° C. |
| Hose temperature: | 220° C. |
| Head temperature: | 240° C. |
| Head angle: | 0.6 degrees |
| Air cylinder pressure: | 90 psi |
| Extruder drive frequency: | 6 Hz |
| Backup drum temperature: | 95° C. |
| Strip speed: | 170 feet per minute |
| Film thickness profile: (microns) | 8.7, 4.7, 2.4, 6.8, 14.4 |
| | Run 3 |
| Polymer: | Dow-Europe PRIMACOR ® 3440 Modified Polyethylene Blend. |
| Extruder temperature: | 220° C. |
| Hose temperature: | 220° C. |
| Head temperature: | 240° C. |
| Head angle: | 0.6 degrees |
| Air cylinder pressure: | 90 psi |
| Extruder drive frequency: | 6 Hz |
| Backup drum temperature: | 102° C. |
| Strip speed: | 170 feet per minute |
| Film thickness profile: (microns) | 12.2, 5.3, 3.3, 7.7, 16.8 |
| | Run 4 |
| Polymer: | VECODUR ® EPPN polyethylene terephthalate (PET) |
| Extruder temperature: | 210° C. |
| Hose temperature: | 200° C. |
| Head temperature: | 220° C. |
| Head angle: | 0.6 degrees |
| Air cylinder pressure: | 90 psi |
| Extruder drive frequency: | 6 Hz |
| Backup drum temperature: | 73° C. |
| Strip speed: | 100 feet per minute |
| Film thickness profile: (microns) | 16.0, 10.6, 9.7, 9.9, 13.3 |

The viscosity of the EPOLENES C-13 used in runs 1 and 2 was measured according to ASTM D4440 on a Rheometrics™ System 4 viscometer using a parallel plate measuring unit. The sensor plate had a 12.5 mm radius and clearance of 2 mm. An estimate of the shear rate based on the conditions at the circumference of the plate gives 6.25 sec−1 for 1 rad/sec, and 625 sec−1 for 100 rad/sec. The results for EPOLENE® C-13 at 190° C. were:

5180 cps at 1 rad/sec 3760 cps at 100 rad/sec.

For Epolena™

C-17, the results were:

578,000 cps at 1 rad/sec 114,100 cps at 100 rad/sec.

Other resins used, such as the DOW PRIMACOR® and VECODUR® EPPN, were not measured, but were presumed similar to EPOLENE® C-17.

The shear rates in the coating gap are much higher than in the test instrument, typically in the range 10,000 sec–1 to 100,000 sec–1. Consequently, the effective viscosity under actual operating conditions may be much lower than measured in a viscometer. The high shear nature of the coater may be the reason why thin coatings can be achieved because the high shear rate may reduce the effective viscosity of the polymer in the gap formed between the coater head and the surface of the strip article.

What we claimed is:

1. Apparatus for coating a surface of an elongated strip article with a solid coating layer of polymer material, comprising:

a sheet feeder for advancing said elongated strip article in a direction of movement;

a first coating head having an elongated open-sided slot and an extended surface immediately adjacent to the open side of the slot;

melting apparatus for heating a solid polymer material to form a melt and for delivering said melt under pressure to said first coating head for extrusion through said slot;

a heater for said first coating head for heating said melt contained within said first coating head;

a support for the first coating head holding said head facing said strip article at an angle to a surface of said article forming a gap between the first coating head and the surface that narrows in the direction of movement of the strip article, and permitting translational movement of the head towards and away from said surface of the strip article; and a load application device for pushing the first coating head towards the strip article as said melt is extruded as a coating onto said surface from the slot to reduce thickness of the coating by pressing said extended surface of the first coating head onto said coating as the coating is formed.

2. Apparatus according to claim 1 further comprising a heated supporting drum for supporting said strip article as it is advanced past said first coating head.

3. Apparatus according to claim 1 wherein said melting apparatus comprises a heated screw mixer for melting and blending particles of polymer material.

4. Apparatus according to claim 3 including a heated pressure hose connecting said screw mixer with said first coating head.

5. Apparatus according to claim 1 further comprising a second coating head for forming a coating of polymer material on a second surface of said strip article, said second coating head being disposed opposite said first coating head.

6. Apparatus according to claim 5 further comprising a heater for heating said strip article positioned upstream of said first and second coating heads.

* * * * *